US007473138B2

(12) United States Patent
Tuin et al.

(10) Patent No.: US 7,473,138 B2
(45) Date of Patent: Jan. 6, 2009

(54) ELECTRICAL CONNECTOR

(75) Inventors: Jacobus Nicolaas Tuin, Best (NL); Yves Braem, Ghent (BE); Johannes Marcelus Broeksteeg, Oss (NL); Marcus Mybrand Wilhelmus Gosselink, St. Michielsgestel (NL)

(73) Assignee: Tyco Electroics Nederland B.V., AR's Hertogenbosch (NL)

( * ) Notice: Subject to any disclaimer, the term of this patent is extended or adjusted under 35 U.S.C. 154(b) by 0 days.

(21) Appl. No.: 11/916,497

(22) PCT Filed: May 24, 2006

(86) PCT No.: PCT/EP2006/004975

§ 371 (c)(1),
(2), (4) Date: Dec. 4, 2007

(87) PCT Pub. No.: WO2006/131215

PCT Pub. Date: Dec. 14, 2006

(65) Prior Publication Data

US 2008/0207023 A1 Aug. 28, 2008

(30) Foreign Application Priority Data

Jun. 8, 2005 (EP) ..... 05012348

(51) Int. Cl.
*H01R 13/648* (2006.01)

(52) U.S. Cl. ..... 439/608; 439/108; 439/701; 439/941

(58) Field of Classification Search ..... 439/95, 439/101, 108, 608, 609, 701, 941
See application file for complete search history.

(56) References Cited

U.S. PATENT DOCUMENTS

| | | | | |
|---|---|---|---|---|
| 6,371,773 | B1 | 4/2002 | Crofoot et al. | |
| 6,379,188 | B1 | 4/2002 | Cohen et al. | |
| 6,517,360 | B1 | 2/2003 | Cohen | |
| 6,808,420 | B2 * | 10/2004 | Whiteman et al. | 439/608 |
| 7,137,832 | B2 * | 11/2006 | Mongold et al. | 439/108 |
| 2003/0064626 | A1 | 4/2003 | Kemmick et al. | |
| 2003/0092291 | A1 | 5/2003 | Lemke et al. | |
| 2007/0207675 | A1 * | 9/2007 | Minich | 439/608 |
| 2007/0218765 | A1 * | 9/2007 | Cohen et al. | 439/608 |

FOREIGN PATENT DOCUMENTS

| | | |
|---|---|---|
| JP | 07161414 | 6/1995 |

* cited by examiner

*Primary Examiner*—James Harvey
(74) *Attorney, Agent, or Firm*—Barley Snyder LLC

(57) ABSTRACT

An electrical connector includes a dielectric housing provided with a plurality of contact modules. Each of the contact modules is provided with a lead frame having mounting contacts electrically connected to mating contacts by signal conductors and ground conductors that extend along a predetermined path within the contact module. The lead frames in adjacent contact modules alternate between a first pattern and a second pattern. The first pattern and the second pattern each have pairs of signal conductors and individual ground conductors arranged in an alternating sequence. Each of the ground conductors has a width transverse to the predetermined path that is substantially equal to a combined width transverse to the predetermined path across the pair of signal conductors in the adjacent contact module such that the ground conductor shields the pair of signal conductors in the adjacent contact module.

21 Claims, 9 Drawing Sheets

ELECTRICAL CONNECTOR

CROSS-REFERENCES TO RELATED APPLICATIONS

This application claims the benefit of the filing date of International Application No. PCT/EP2006/004975, filed May 24, 2006, which claims the benefit of the filing date of European Application No. 05012348.8, filed Jun. 8, 2005.

FIELD OF THE INVENTION

The invention relates generally to electrical connectors and, more particularly, to an electrical connector for transmitting signals in differential pairs.

BACKGROUND

With the ongoing trend toward smaller, faster, and higher performance electrical components such as processors used in computers, routers, switches, etc., it has become increasingly important for electrical interfaces along electrical paths to also operate at higher frequencies and at higher densities with increased throughput.

In a traditional approach for interconnecting circuit boards, one circuit board serves as a back-plane and the other as a daughter board. The back-plane typically has a connector, commonly referred to as a header, that includes a plurality of signal pins or contacts which connect to conductive traces on the back-plane. The daughter board typically has a connector, commonly referred to as a receptacle connector, that also includes a plurality of contacts or pins. Typically, the receptacle connector is a right angle connector that interconnects the back-plane with the daughter board so that signals can be routed between the two. The right angle connector typically includes a mating face that receives the plurality of signal pins from the header on the back-plane and contacts that connect to the daughter board.

At least some board-to-board connectors are differential connectors wherein each signal requires two lines that are referred to as a differential pair. For better performance, a ground contact is associated with each differential pair. The receptacle connector typically includes a number of modules having contact edges that are at right angles to each other. The modules may or may not include a ground shield. As the transmission frequencies of signals through the receptacle connector increases, it becomes more desirable to maintain a desired impedance through the receptacle connector to minimize signal degradation. A ground shield is sometimes provided on the module to reduce interference or crosstalk. In addition, a ground shield may be added to the ground contacts on the header. Improving connector performance and increasing contact density to increase signal carrying capacity without increasing the size of the receptacle connector or header is challenging.

Some older connectors, which are still in use today, operate at speeds of one gigabit per second or less. By contrast, many of today's high performance connectors are capable of operating at speeds of up to ten gigabits or more per second. As would be expected, the higher performance connector also comes with a higher cost.

U.S. Pat. No. 6,808,420, granted to the applicant of the present application on Oct. 26, 2004, discloses an electrical connector comprising a connector housing holding signal contacts and ground contacts in an array organized into rows. Each row includes pairs of the signal contacts and some of the ground contacts arranged in a pattern, wherein adjacent first and second rows have respective different first and second patterns.

U.S. Pat. No. 6,379,188, granted on Apr. 30, 2002, shows an electrical connector for transferring a plurality of differential signals between electrical components. The electrical connector is made of modules that have a plurality of pairs of signal conductors with a first signal path and a second signal path.

Electrical connectors according to the prior art comprise a plurality of contacts embedded in a plastic housing. FIG. 1 shows a plurality of mating contacts 3 in such an electrical connector represented without the plastic housing. Each of the mating contacts 3 is electrically connected to a corresponding mounting contact 6 by a conductor 5. The plurality of conductors 5 connecting the mounting contacts 6 with the corresponding mating contacts 3 arranged on one of the rows, constitutes a so-called lead frame, an example of which is represented in FIG. 2.

FIG. 3 shows a cross-sectional view of the plurality of conductors 5 shown in FIG. 1, taken along one of lines A-A, B-B or C-C. In the electrical connector according to the prior art, the plurality of conductors 5 have electrical characteristics, which may vary depending on the position of a particular conductor within the electrical connector. Indeed, the conductors 5 located in outer regions of the electrical connector, which are identified in FIG. 3 by the conductors 5 represented in black, have electrical characteristics that vary from the electrical characteristics of the conductors 5 arranged in inner regions of the electrical connector, which are represented by the conductors 5 in FIG. 3 in white. In particular, the total capacitance of the individual conductors 5 arranged in the outer regions of the electrical connector is typically lower than the total capacitance of the conductors 5 located in the inner regions of the electrical connector. This phenomenon is due to the fact that the conductors 5 in the outer regions do not have neighbors on one side, which results in non-uniform electrical characteristics. These non-uniform electrical characteristics may lead to a degradation of the signals transmitted by the electrical connector.

SUMMARY

The object of the present invention is therefore to provide an electrical connector with improved electrical characteristics, such as reduced crosstalk and uniform electrical properties of its conductors.

According to a first aspect of the present invention, an electrical connector is provided that comprises a housing and a plurality of contact modules in the housing. Each of the contact modules comprises a mating edge and a mounting edge. Each of the mating and mounting edges has a row of mating contacts and mounting contacts, respectively. Each mating contact is electrically connected to a corresponding mounting contact by signal conductors and ground conductors extending along a predetermined path within the contact module to form a lead frame in each contact module, the ground conductors and signal conductors being arranged in an adjacent relationship to provide electrical shielding. The signal conductors and ground conductors of several contact modules are arranged, when seen in a cross-sectional view through the lead frames, in an array having outer and inner layers, wherein at least a portion of the signal conductors and ground conductors in the outer layers has a width transverse to the predetermined path that is different from a width transverse to the predetermined path of the signal conductors and ground conductors in the inner layers.

By changing the shape of the signal conductors and ground conductors in the outer layers, in particular, by changing the width of the signal conductors and ground conductors in the outer layers, the electrical characteristics of the signal and ground conductors in the electrical connector can be made uniform. Indeed, changing the width of at least a portion of the signal conductors and ground conductors in the outer layers allows to reduce the difference in total capacitance between the plurality of mating and mounting contacts comprised in one lead frame. The fact that the signal and ground conductors in the outer layers, located at one end of the lead frame, do not have neighbors on one side, can therefore be compensated.

According to a second aspect of the present invention, an electrical connector is provided, which comprises a housing and a plurality of contact modules in the housing. Each of the contact modules comprises a mating edge and a mounting edge. Each of the mating and mounting edges has a row of mating and mounting contacts, respectively. Each mating contact is electrically connected to a corresponding mounting contact by signal conductors and ground conductors extending along a predetermined path within the contact module to form a lead frame in each contact module. The ground conductors and signal conductors are arranged in an adjacent relationship to provide electrical shielding. The signal conductors and ground conductors of several contact modules are arranged, when seen in a cross-sectional view through the lead frames, in an array having outer and inner layers, wherein a pitch between the outer layers is different from a pitch between the inner layers.

By changing the spatial arrangement of the conductors in the outer layers, in particular, by foreseeing a pitch between the conductors in the outer layers that is different from a pitch between the conductors in the inner layers, the electrical properties of the signal and ground conductors within the electrical connector can be made uniform.

According to a preferred embodiment of the present invention, an electrical connector is provided, wherein the width of the signal conductors and ground conductors in the outer layers, is different from the width of the signal conductors and ground conductors in the inner layers and a pitch between the outer layers is different from a pitch between the inner layers. Foreseeing such an electrical connector allows to achieve uniform electrical characteristics of the signal and ground conductors within the electrical connector.

According to a further embodiment of the present invention, the signal conductors and ground conductors are arranged in one of a first and second pattern, wherein adjacent contact modules in the housing have a different one of the first and second patterns. Each of the first and second patterns includes pairs of signal conductors and individual ground conductors arranged in an alternating sequence. Each of the ground conductors has a width transverse to the predetermined path that is substantially equal to a combined transverse width across the pair of signal conductors in an adjacent contact module, the ground conductor thereby shielding the pair of signal conductors in the adjacent contact module.

Since the lead frames in adjacent contact modules have different signal and ground conductor patterns, the signal conductors arranged in differential pairs can be shielded by adjacent ground conductors to reduce crosstalk in the electrical connector and facilitate increased throughput through the electrical connector. Further, shielding for the signal conductors can be provided by the ground conductors above and below the signal conductors within the same lead frame, which cooperate with the ground conductors in an adjacent lead frame to substantially isolate each differential signal pair from other differential signal pairs in the electrical connector.

Alternatively, the signal conductors and ground conductors of the electrical connector can be arranged in one of a first and second pattern, wherein adjacent contact modules in the housing having a different one of the first and second patterns. The first and second patterns each include pairs of signal conductors and pairs of ground conductors arranged in an alternating sequence. Each of the pairs of ground conductors has a combined transverse width to the predetermined path that is substantially equal to a combined transverse width across the pair of signal conductors in an adjacent contact module. The pair of ground conductors thereby shield the pair of signal conductors in the adjacent contact module.

In the electrical connector according to this particular embodiment, a pair of ground conductors ensures electrical shielding of a pair of signal conductors in the adjacent contact module. In this manner, the signal conductors arranged in different pairs can be shielded by a pair of adjacent ground conductors to reduce crosstalk in the electrical connector. Further, since a pair of shielding ground conductors is arranged in correspondence with a pair of signal conductors in the adjacent lead frame, different assignments of the signal conductors and ground conductors can be achieved, which is particularly advantageous when high data rates are not required.

According to another aspect of the present invention, a lead frame for an electrical contact module is provided, which comprises a first row of mating contacts defining a mating edge and a second row mounting contacts defining a mounting edge. Each first row of mating contacts and each second row of mounting contacts is electrically connected by first and second conductors extending along the predetermined path within the lead frame. At least a portion of the first conductors connecting the mating contacts and mounting contacts arranged at an end of the first and second row has a width transverse to the predetermined path that is different from the width transverse to the predetermined path of the second conductors connecting the mating contacts and the mounting contacts of the first and second rows.

According to an advantageous embodiment of the lead frame according to the present invention, the first conductors are essentially in outer layers of the lead frame and the second conductors are essentially in inner layers of the lead frame. Foreseeing at least a portion of the conductors in the outer layers of the lead frame with a width that is different from a width of the conductors in the inner layers of the lead frame allows to improve the electrical characteristics of the lead frame, in particular, it is possible to obtain a lead frame in which the signal and ground conductors have more uniform electrical properties. Hence, there is a smaller difference between the electrical properties of the conductors in the outer layers and those of the inner layers, thus guaranteeing a high signal integrity. This aspect is particularly advantageous when several lead frames are integrated into one electrical connector transmitting information signals, as such an electrical connector implementing a plurality of lead frames according to the present invention may transport information signals while guaranteeing very low signal degradation.

According to yet another embodiment of the lead frame according to the present invention, a lead frame is provided that comprises a first row of mating contacts defining a mating edge and a second row of mounting contacts defining a mounting edge. Each row of mating contacts and mounting contacts is electrically connected by first and second conductors extending along the predetermined path within the lead frame. A pitch between two adjacent first conductors connecting the mating contacts and mounting contacts arranged at an end of the first and second row is different from a pitch between two adjacent second conductors connecting the mating contacts and mounting contacts of the first and second row.

It is particularly advantageous to foresee the first conductors as outer layers of the lead frame and the second conductors as inner layers of the lead frame, wherein the pitch between two adjacent conductors in the outer layers is different from the pitch between two adjacent conductors in the inner layers. Such a lead frame has the advantage of comprising signal and ground conductors with uniform electrical characteristics. When implementing such a lead frame in an electrical connector that transports information signals, an electrical connector can be provided that has the advantage of transporting information signals while guaranteeing a high signal integrity.

According to a preferred embodiment of the present invention, a contact assembly is provided, which comprises at least a first and second lead frame according to the present invention, wherein the second lead frame is adjacent to the first lead frame. The signal conductors and ground conductors of the first lead frame are arranged in one of a first and second pattern. Each of the first and second patterns including pairs of signal conductors and individual ground conductors arranged in an alternating sequence. Each ground conductor of the first lead frame has a width transverse to the predetermined path that is substantially equal to a combined transverse width across a pair of signal conductors in the second adjacent lead frame having signal and ground conductors arranged in the other of the patterns, the ground conductor of the first lead frame thereby shielding the pair of signal conductors in the second adjacent lead frame.

Alternatively, a contact assembly is provided, which comprises at least a first and a second lead frame according to the present invention, wherein the second lead frame is adjacent to the first lead frame. The signal conductors and ground conductors of the first lead frame are arranged in one of a first and second pattern. Each first and second patterns include pairs of signal conductors and pairs of ground conductors arranged in an alternating sequence. Each pair of ground conductors of the first lead frame has a combined transverse width to the predetermined path that is substantially equal to a combined transverse width across a pair of signal conductors in the second adjacent lead frame having signal and ground conductors arranged in the other of the patterns, the pair of ground conductors of the first lead frame thereby shielding the pair of signal conductors in the second adjacent lead frame.

BRIEF DESCRIPTION OF THE DRAWINGS

The present invention will be described in detail in the following based on the figures enclosed with the application.

DETAILED DESCRIPTION OF THE EMBODIMENT(S)

Figure 1:
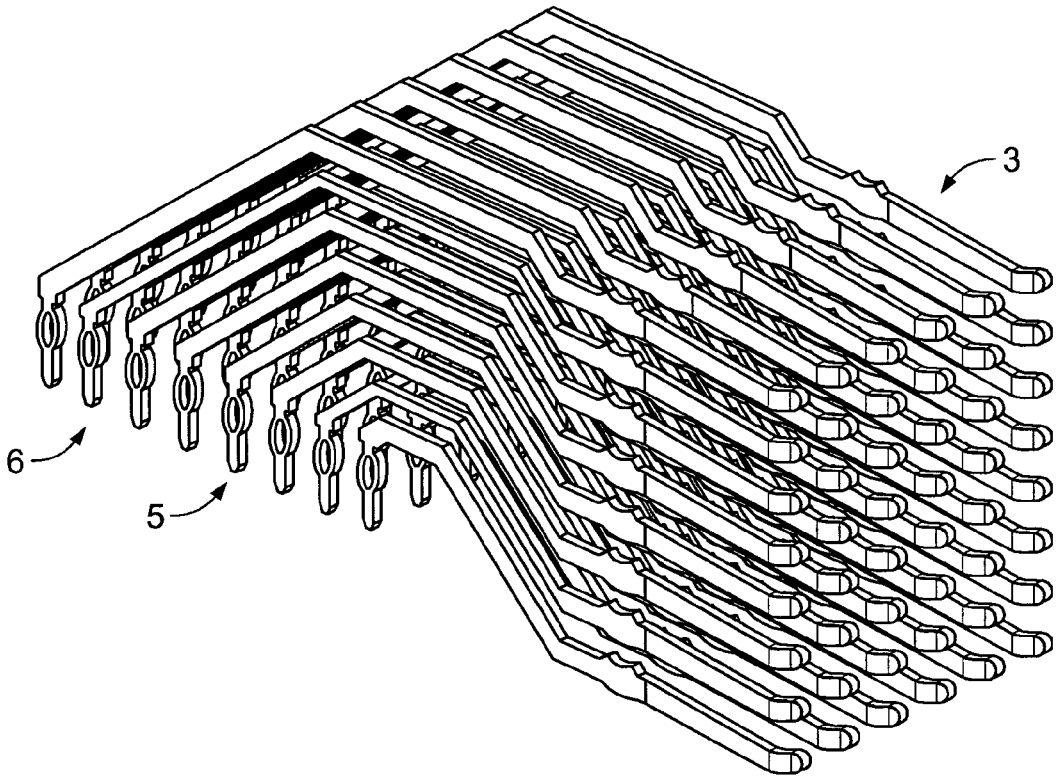
FIG. 1 is a perspective view of a plurality of lead frames within an electrical connector according to the prior art.
Figure 2:
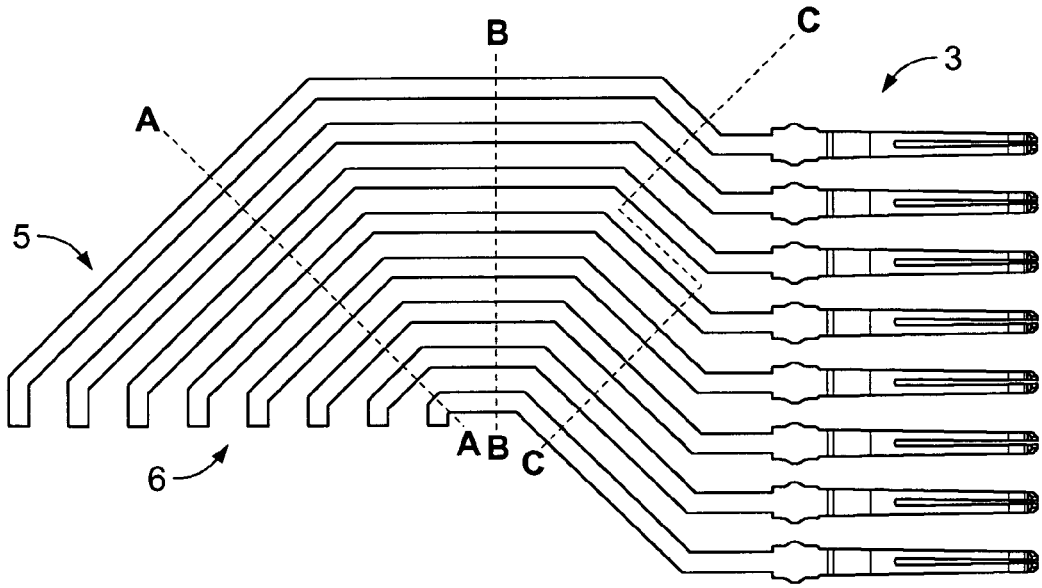
FIG. 2 is a side view of one of the lead frames shown in FIG. 1.
Figure 3:
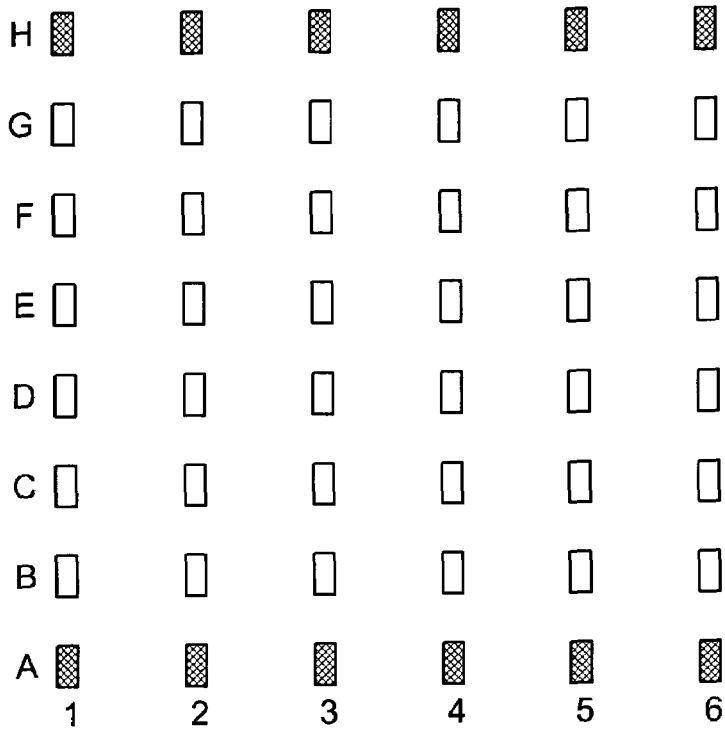
FIG. 3 is a cross-sectional view of the plurality of lead frames shown in FIG. 1 taken along one of lines A-A, B-B or C-C shown in FIG. 2.
Figure 4:
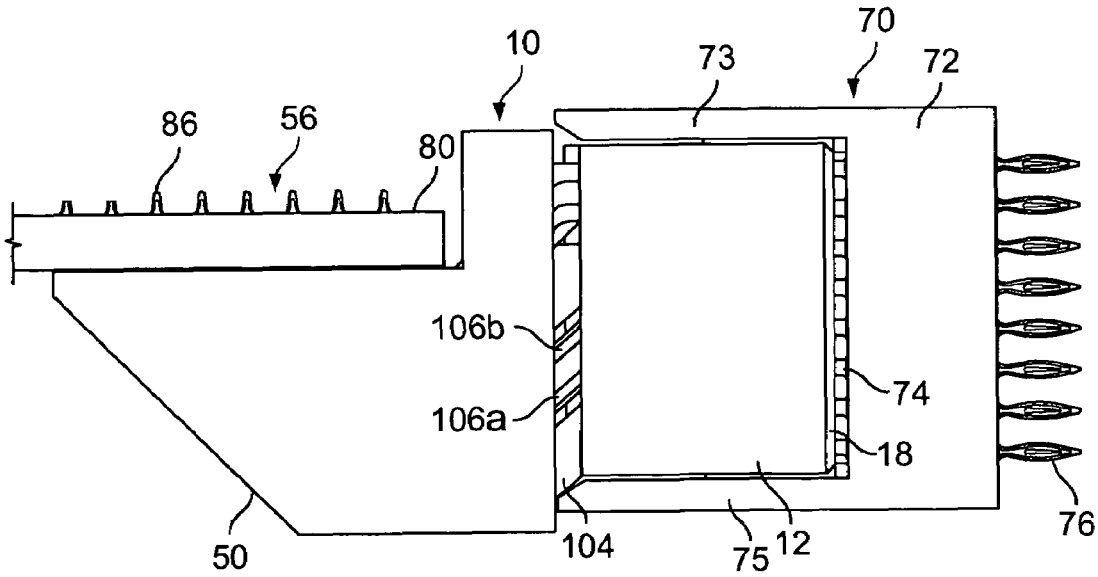
FIG. 4 is a side view of a female electrical connector according to the present invention mated with a male mating connector.

FIG. 4 illustrates a female electrical connector 10 formed in accordance with an exemplary embodiment of the present invention. While the electrical connector 10 will be described with particular reference to a receptacle connector formed as a right-angle connector interconnecting a back-plane with a daughter board, it is to be understood that the benefits described herein are also applicable to other connectors in alternative embodiments.

Figure 9:
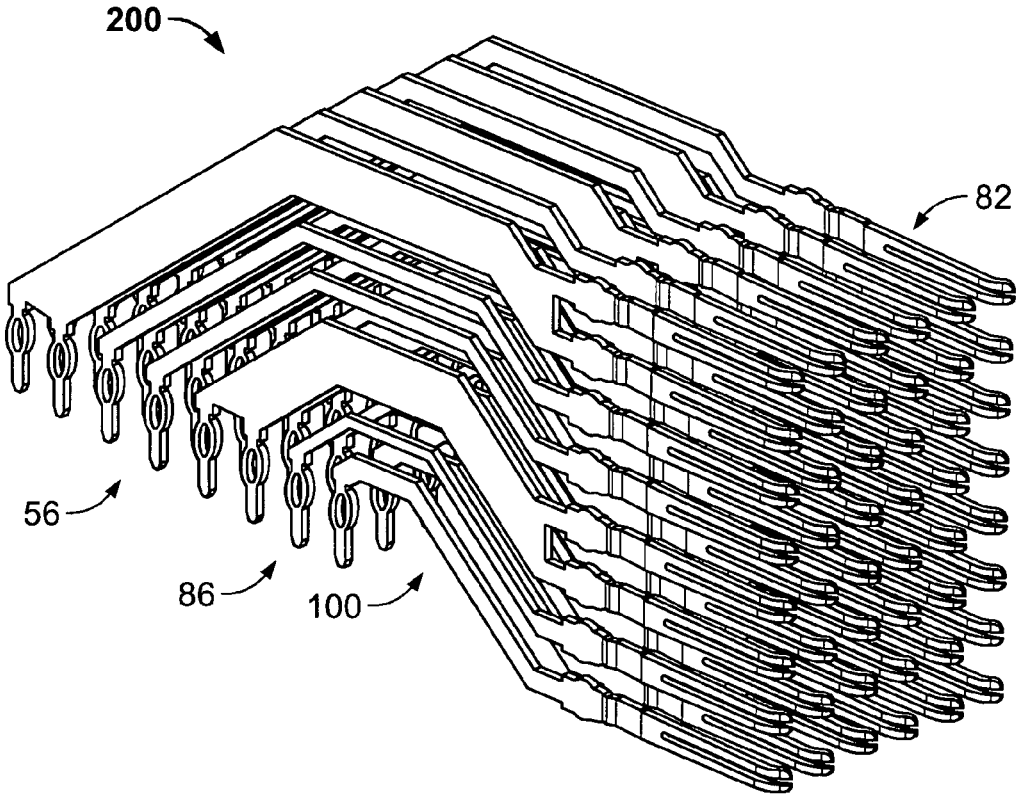
FIG. 9 is a perspective view of a plurality of lead frames according to a first embodiment of the present invention.

The electrical connector 10 includes a dielectric housing 12. A plurality of contact modules 50 are connected to the dielectric housing 12. The contact modules 50 define a mounting face 56, which comprises a plurality of mounting contacts 86. In a preferred embodiment, the mounting face 56 is substantially perpendicular to a mating face 18 of the dielectric housing 12, such that the electrical connector 10 interconnects electrical components that are substantially at a right angle to one another. The mounting contacts 86 are adapted to be mounted on a circuit board 80. The dielectric housing 12 includes a plurality of mating contacts 82 (FIG. 9) that are accessible to corresponding mating elements 76 through the mating face 18 of the dielectric housing 12. A plurality of ground conductors 104 and signal conductors 106*a*, 106*b* connect the mounting contacts 86 and the mating contacts 82 (FIG. 9).

A male mating connector 70 comprising the mating elements 76 can be mated with the mating contacts 82 (FIG. 9) of the electrical connector 10. The mating connector 70 comprises a plastic body 72 in which the mating elements 76 are embedded. The plastic body 72 of the mating connector 70 comprises two side parts 73, 75. The mating elements 76 are embedded in the plastic body 72 in such a way that a longitudinal axis of the mating elements 76 is parallel to a longitudinal axis of the side parts 73, 75. The plastic body 72 comprises a cavity arranged between the side parts 73, 75. The cavity has dimensions such that the dielectric housing 12 of the electrical connector 10 can be fitted into the cavity of the mating connector 70.

The mating elements 76 of the mating connector 70 protrude out of the plastic body 72 on the side of the mating connector 70 oriented towards the cavity in which the dielectric housing 12 of the electrical connector 10 can be fitted. The mating elements 76 protrude towards the cavity of the mating connector 70 and have mating element ends 74. The mating element ends 74 can be introduced through the mating face 18 of the dielectric housing 12 to mate with the mating contacts 82 (FIG. 9) of the electrical connector 10.

Figure 5:
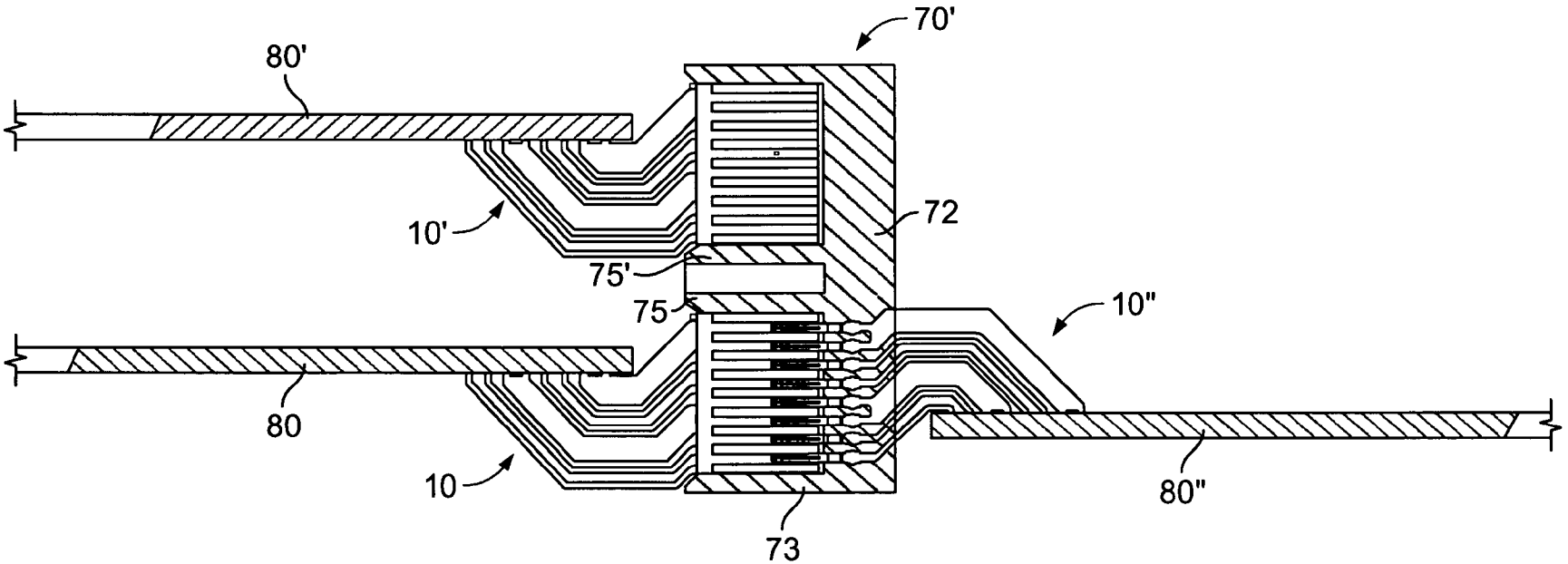
FIG. 5 is a side view of a multi-board arrangement implementing the electrical connector, a second electrical connector, and a third electrical connector with a mating connector according to the present invention.

FIG. 5 shows a multi-board arrangement comprising the circuit board 80 on which the electrical connector 10 is mounted, a second circuit board 80' on which a second electrical connector 10' is mounted and a third circuit board 80" on which a third electrical connector 10" is mounted. A mating connector 70' connects the circuit board 80, second circuit board 80' and third circuit board 80" electrically. The mating connector 70' is formed essentially of two of the mating connectors 70 shown in FIG. 4.

The circuit board 80, on which the electrical connector 10 is mounted and the second circuit board 80', on which the second electrical connector 10' is mounted, are arranged in an essentially co-planar position. The dielectric housing 12 of the electrical connector 10 is received in a cavity, located between side parts 73, 75 of the mating connector 70'. A second dielectric housing 12' of the second electrical connector 10' is received in a second cavity located between a second side part 73' and a second side part 75' adjacent to the side part 75 of the mating connector 70'. On the face of the plastic body 72 of the mating connector 70', which is oriented opposite to the cavity and the second cavity, the third electrical connector 10" mounted on the third circuit board 80" is mated with the electrical connector 10 through the mating connector 70'. The electrical connector 10 and the third electrical connector 10" are mated in such a way through the mating connector 70' that the circuit board 80 and the third circuit board 80" are in a co-planar arrangement.

Figure 6:
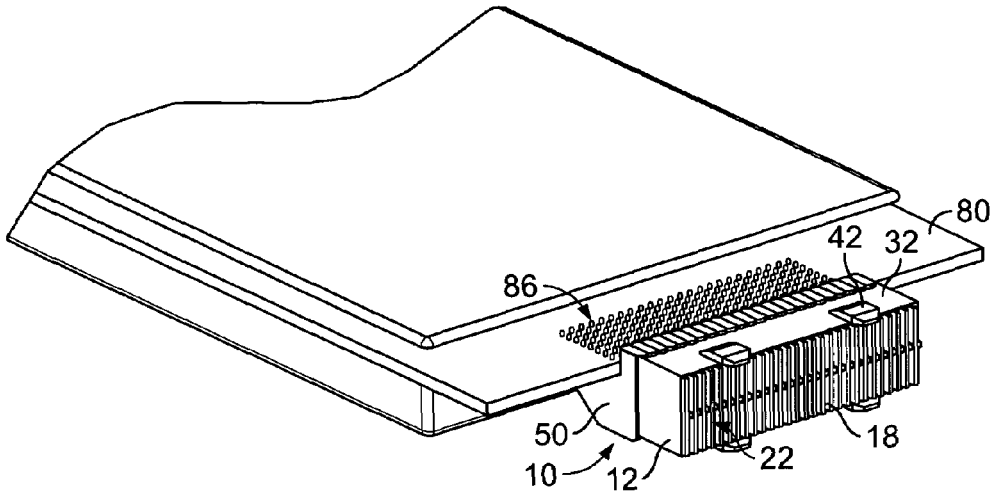
FIG. 6 is a perspective view of the electrical connector according to the present invention.

FIG. 6 shows the electrical connector 10 according to the present invention. The mounting contacts 86 of the electrical connector 10 are mounted on the circuit board 80. The dielectric housing 12 of the electrical connector 10 comprises the mating face 18, which includes a plurality of contact cavities 22 that are configured to receive the corresponding mating elements 76. Further, the dielectric housing 12 comprises an alignment rib 42 arranged on an upper face 32 of the dielectric housing 12. The alignment rib 42 brings the electrical connector 10 into alignment with the mating connector 70 during the mating process so that the mating element ends 74 of the mating connector 70 are received in the contact cavities 22 without damage.

Figure 7:
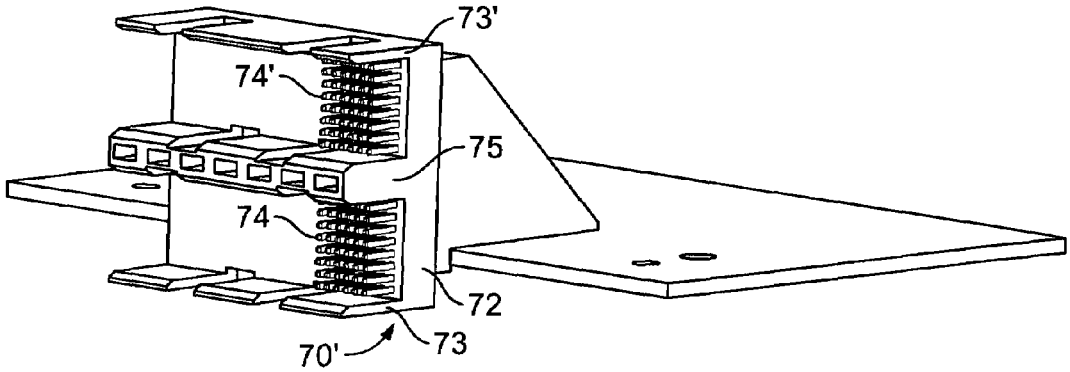
FIG. 7 is a perspective view of the mating connector according to the present invention.

FIG. 7 illustrates the mating connector 70' according to the present invention. The mating connector 70' has the second cavity comprised respectively between the second side part 73' and the second side part 75', and the cavity comprised respectively between the side part 75 and the side part 73. The mating element ends 74 and the second mating element ends 74' are arranged in the respective cavity and second cavity of the plastic body 72 of the mating connector 70'. The mating element ends 74 and the second mating element ends 74' are male mating elements, which are adapted to be mated with the mating contacts 82 (FIG. 9) in the contact cavities 22 of the mating face 18 of the electrical connector 10 and with the mating contacts in contact cavities of the mating face of the second electrical connector 10'.

Figure 8:
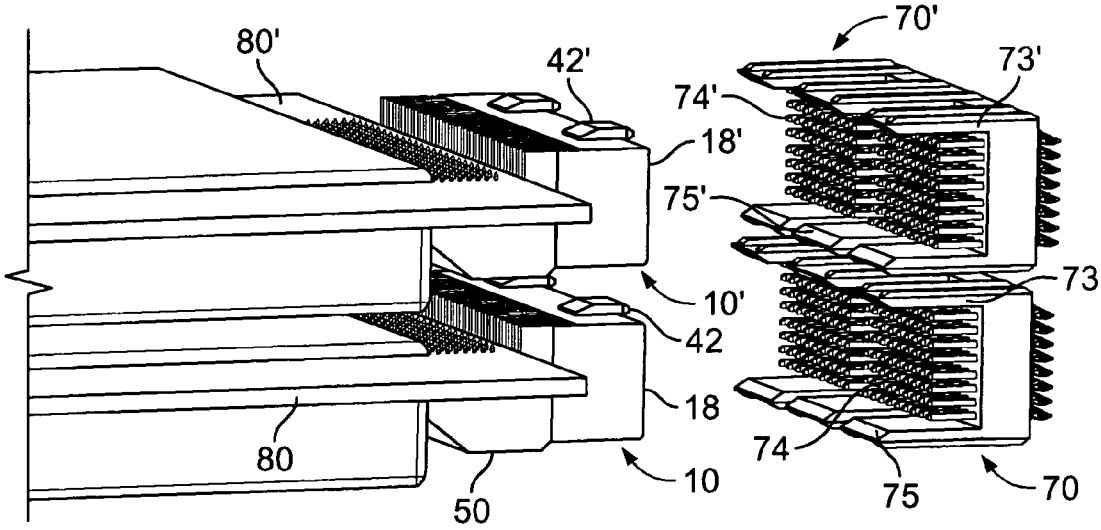
FIG. 8 is a perspective view of a multi-board arrangement comprising two electrical connectors and two mating connectors according to the present invention.

FIG. 8 shows a multi-board arrangement as shown in FIG. 5, wherein the electrical connector 10 is mounted on the circuit board 80 and the second electrical connector 10' is mounted on the second circuit board 80'. The electrical connector 10 and the second electrical connector 10' are adapted to be mated with each of the mating connectors 70, 70'. In particular, the mating contacts 82 (FIG. 9) of the mating face 18 of the electrical connector 10 and the second mating face 18' of the second electrical connector 10' are mated with the respective mating element ends 74 and second mating element ends 74' of each of the respective mating connectors 70, 70'.

FIG. 9 shows a perspective view of a plurality of lead frames 100, 200 that are arranged within the electrical connector 10 according to the present invention. The lead frames 100, 200 comprise a plurality of conductors 102, 202 (FIGS. 10 and 11), respectively. The conductors 102, 202 (FIGS. 10 and 11) extend along a predetermined path to electrically connect the mating contacts 82 to the corresponding mounting contacts 86. The mating contacts 82 are essentially perpendicular to the mounting contacts 86.

Figure 10:
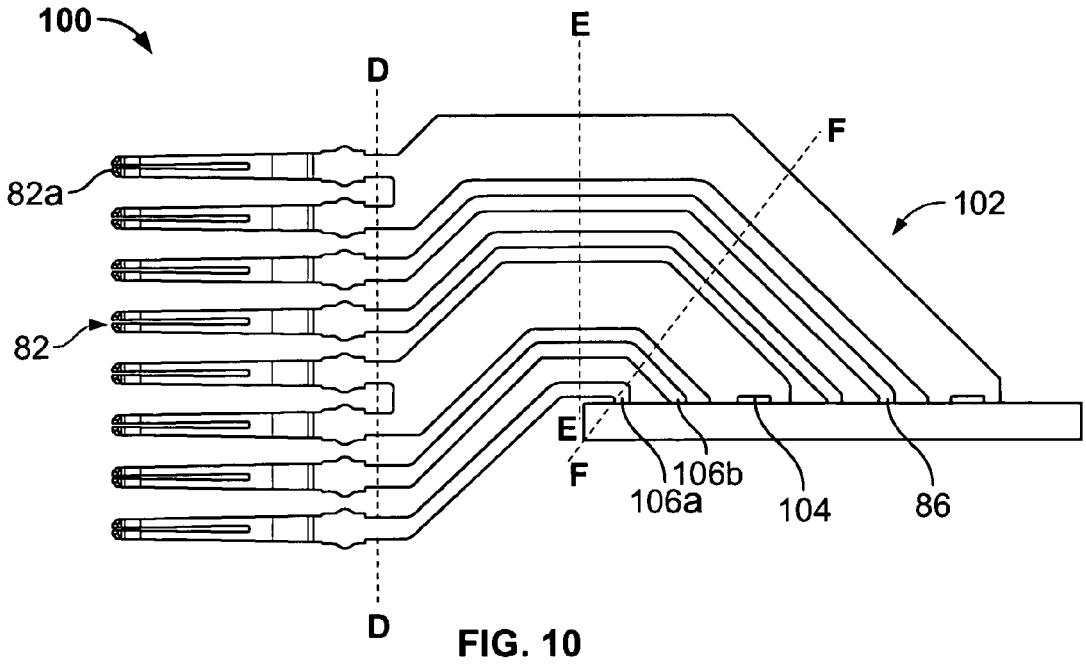
FIG. 10 is a side view of one of the lead frames in FIG. 9.

FIG. 10 is a side view of the lead frame 100 that includes the plurality of conductors 102. The conductors 102 include ground conductors 104 and signal conductors 106*a*, 106*b* that extend along the predetermined path to electrically connect each contact portion 82*a* of the mating contacts 82 to the corresponding mounting contacts 86.

The mating contacts 82 and the mounting contacts 86 include both signal and ground contacts that are connected to one another by the corresponding signal conductors 106*a*, 106*b* and the ground conductors 104. The ground conductors 104 and the signal conductors 106*a*, 106*b* are arranged in a first pattern that includes pairs of the signal conductors 106*a*, 106*b* and individual ground conductors 104 arranged in an alternating sequence. For example, in a first pattern shown in FIG. 10, the individual ground conductor 104 is foreseen in the form of a shielding blade that is arranged in an adjacent position to the pair of signal conductors 106*a*, 106*b* within the lead frame 100.

Figure 11:
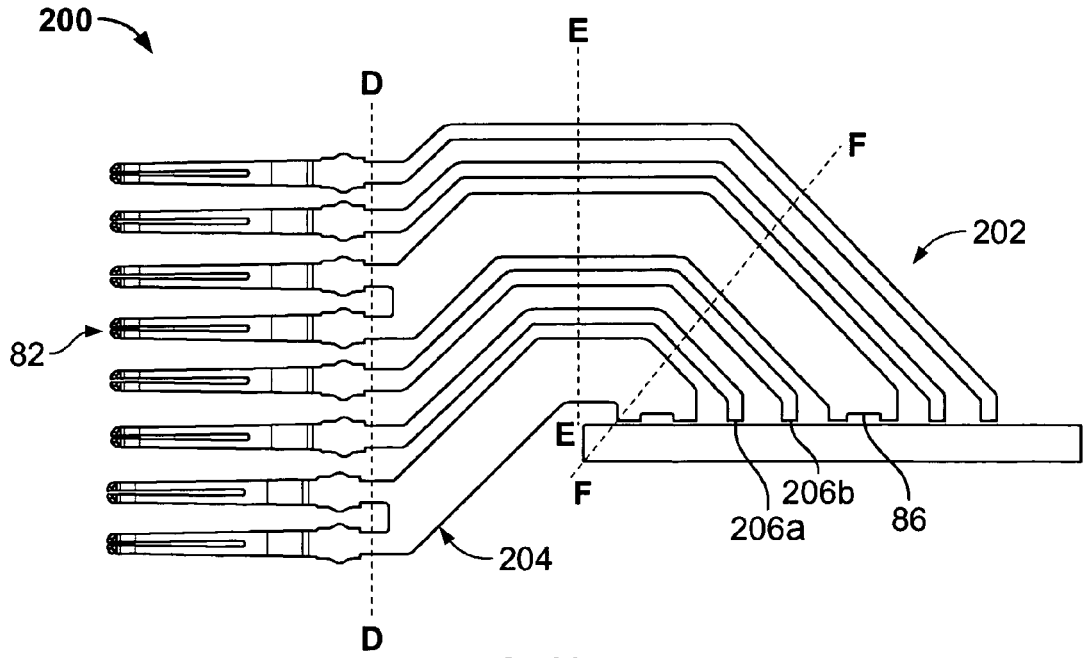
FIG. 11 is a side view of one of the lead frames in FIG. 9 that is adjacent to the lead frame of FIG. 10.

FIG. 11 shows a side view of the lead frame 200, which is adjacent to the lead frame 100 shown in FIG. 10. The lead frame 200 comprises a plurality of the conductors 202. The conductors 202 include signal conductors 206*a*, 206*b* and ground conductors 204 that extend along the predetermined path to electrically connect each of the mating contacts 82 to the corresponding mounting contacts 86.

The ground conductors 204 and the signal conductors 206*a*, 206*b* in FIG. 11 are arranged in a second pattern that includes pairs of signal conductors 206*a*, 206*b* and individual ground conductors 204 arranged in an alternating sequence. The individual ground conductor 204 is foreseen in the form of a shielding blade that is arranged on one end of the lead frame 200. The pair of signal conductors 206*a*, 206*b* is arranged closest to the shielding blade forming the individual ground conductor 204. This sequence according to the second pattern is therefore designed in such a way that the pair of signal conductors 206*a*, 206*b* and the individual ground conductor 204 are arranged in an alternating sequence to the sequence shown in FIG. 10.

The ground conductors 204 of the lead frame 200 shown in FIG. 11 have a width transverse to the longitudinal path of the ground conductors 204 that is substantially equal to a combined transverse width of the pair of signal conductors 106*a*, 106*b* of the adjacent lead frame 100 shown in FIG. 10. Likewise, the ground conductors 104 of the lead frame 100 shown in FIG. 10 have a width transverse to the longitudinal path of the ground conductors 104 that is substantially equal to a combined transverse width of the pair of signal conductors 206*a*, 206*b* of the adjacent lead frame 200 shown in FIG. 11. In this manner, the ground conductors 104, 204 shield the signal conductors 106*a*, 106*b*, 206*a*, 206*b* in the mutual adjacent lead frame 100, 200.

Figure 12:
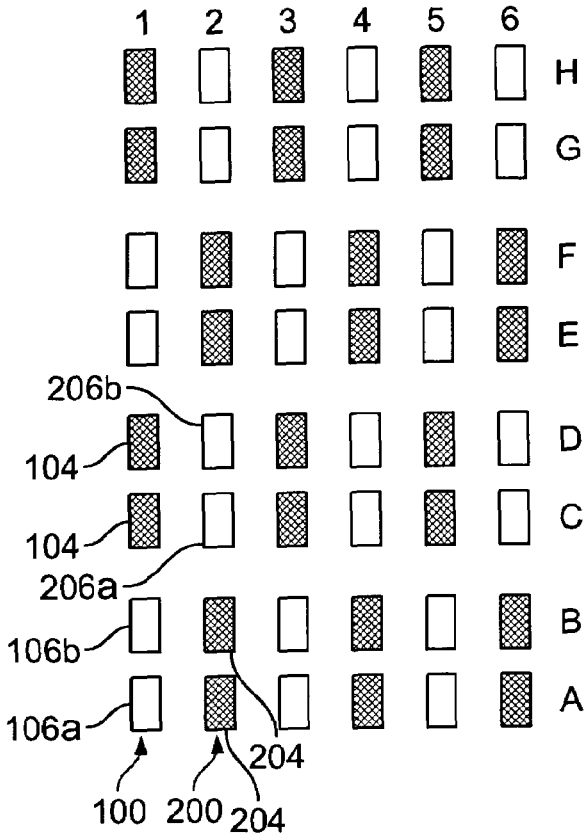
FIG. 12 is a cross-sectional view of the plurality of lead frames shown in FIG. 9 taken along line D-D shown in FIGS. 10 and 11.

FIG. 12 shows a cross-sectional view of the mating edge of the plurality of lead frames 100, 200, taken along line D-D shown in FIGS. 10 and 11.

The plurality of signal conductors 106*a*, 106*b*, 206*a*, 206*b* and the ground conductors 104, 204 are arranged in an array, when seen in a cross-sectional view through the lead frames 100, 200, taken along the line D-D. In a preferred embodiment, the signal conductors 106*a*, 106*b*, 206*a*, 206*b* and the ground conductors 104, 204 are arranged in an essentially rectangular or square array, as represented in FIG. 12.

The conductors 102, 202 in FIG. 12 are shown either in white to identify the signal conductors 106*a*, 106*b*, 206*a*, 206*b* or black to identify the ground conductors 104, 204. Moreover, a grid characterized by the numbers 1 to 6 and the letters A to H allows to identify the array of signal conductors 106*a*, 106*b*, 206*a*, 206*b* and ground conductors 104, 204. The plurality of lead frames 100, 200 are arranged in an alternating sequence, such that two adjacent lead frames 100, 200 have different conductor patterns. Specifically, the lead frames 100, 200 are configured such that the signal conductors 106*a*, 106*b*, 206*a*, 206*b* in each of the lead frames 100, 200 are spatially aligned with the ground conductors 104, 204 in an adjacent one of the lead frames 100, 200. Likewise, the signal conductors 106*a*, 106*b*, 206*a*, 206*b* in each of the lead frames 100 200 are spatially aligned with the ground conductors 104, 204 in an adjacent one of the lead frames 100.

In this manner, the signal conductors 106*a*, 106*b*, 206*a*, 206*b* arranged in differential pairs are shielded by the adjacent ground conductors 104, 204 to reduce crosstalk in the electrical connector 10 and facilitate increased throughput through the electrical connector 10. Further, shielding for the signal conductors 106*a*, 106*b*, 206*a*, 206*b* is provided by the ground conductors 104, 204 above and below the signal conductors 106*a*, 106*b*, 206*a*, 206*b* in the same lead frame 100, 200, which cooperate with the ground conductors 104, 204 in an adjacent one of the lead frames 100, 200 to substantially isolate each differential signal pair from other differential signal pairs in the electrical connector 10.

Figure 13:
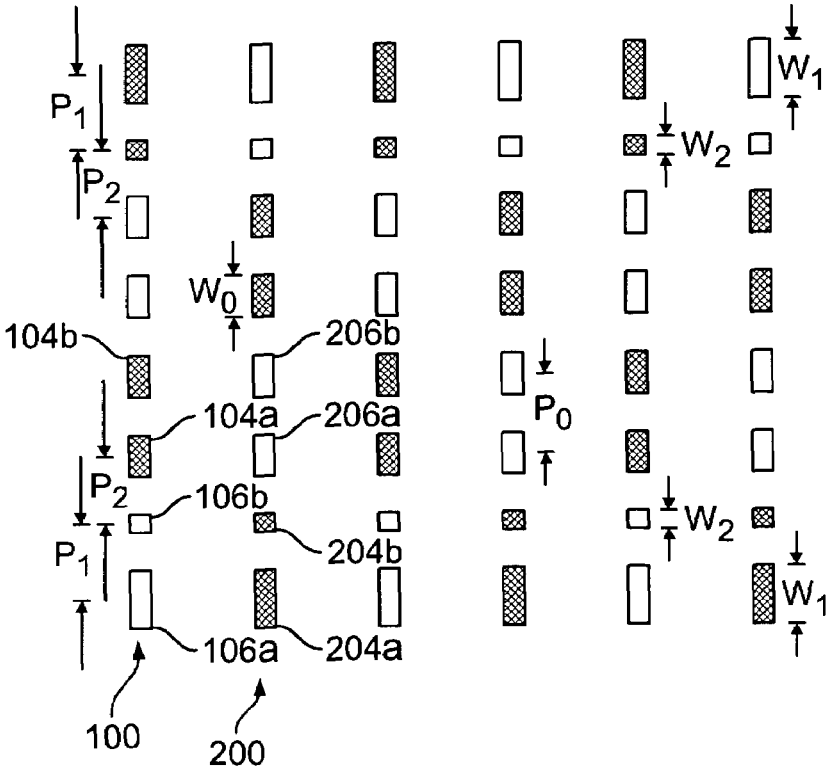
FIG. 13 is a cross-sectional view of a plurality of lead frames according a preferred embodiment of the present invention, taken along the line D-D shown in FIGS. 10 and 11.

FIG. 13 describes a cross-sectional view of the plurality of lead frames 100, 200 according to a preferred embodiment of the present invention, taken along the line D-D shown in FIGS. 10 and 11.

According to a first aspect of this preferred embodiment of the present invention, the signal conductors 106*a*, 106*b*, 206*a*, 206*b* and the ground conductors 104, 204 of the plurality of lead frames 100, 200, when seen in the cross-sectional view through said plurality of lead frames 100, 200, form an array. The array has outer conductors located on the ends of the plurality of lead frames 100, 200, and inner conductors, located between the ends of the plurality of lead frames 100, 200. The plurality of signal conductors 106*a*, 106*b* and ground conductors 204*a*, 204*b*, when seen in a cross-sectional view through the lead frames 100, 200, form what will be referred to as outer layers of the array. Further, the plurality of signal conductors 206*a*, 206*b* and ground conductors 104*a*, 104*b* located between the outer conductors of the plurality of lead frames 100, 200, when seen in a cross-sectional view through the plurality of lead frames 100, 200, are arranged in what will be referred to as inner layers of the array.

The signal conductors 106*a*, 106*b* and the ground conductors 204*a*, 204*b* located in the outer layers of the array of the conductors 102, 202, have a width $W_1$, $W_2$ transverse to the predetermined path that is different from a width $W_0$ transverse to the predetermined path of the signal conductors 206*a*, 206*b* and the ground conductors 104*a*, 104*b* in the inner layers of the array of conductors 102, 202. The width $W_1$, $W_2$ of the signal conductors 106*a*, 106*b* and the ground conductors 204*a*, 204*b* located in the outer layers of the array of the conductors 102, 202 is different from the width $W_0$ of the conductors 102, 202 located in the inner layers of the array, so as to compensate for the fact that the signal conductors 106*a* and the ground conductors 204*a* located on both ends of the lead frames 100, 200 do not have neighbors on one side.

Providing outer conductors of the plurality of lead frames 100, 200, which have a width that is different from the width of the conductors 102, 202 arranged in the inner layers of the array of the conductors 102, 202 allows to render the electrical characteristics of the plurality of conductors 102, 202 uniform. In particular, the difference in capacitance between two of the adjacent conductors 102, 202 located in the outer layers of the array can be reduced.

According to an advantageous embodiment of the present invention, the width $W_1$ of the outer signal conductors 106*a* and the outer ground conductors 204*a* on both ends of the plurality of lead frames 100, 200 is larger than the width $W_0$ of the conductors 102, 202 located in the inner layers of the array.

According to yet another preferred embodiment of the present invention, a pitch $P_1$ between the outer layers of the plurality of conductors 102, 202 is different from a pitch $P_0$ between the inner layers of the plurality of conductors 102, 202. The pitch $P_1$ between the two signal conductors 106*a*, 106*b* or between the two ground conductors 204*a*, 204*b* that are arranged in the outer layers of the array is different from the pitch $P_0$ separating two of the conductors 102, 202 arranged in the inner layers of said array.

According to another aspect of the present invention, the signal conductor 106*b* and the ground conductor 204*b* arranged closest to the signal conductor 106*a* and the ground conductor 204*a* located on both ends of the array of the conductors 102, 202 have a width $W_2$ transverse to the predetermined path that is smaller than the width $W_0$ of the conductors 102, 202 located in the inner layers of the array.

According to yet another aspect of the present invention, the pitch $P_2$ between the adjacent signal conductors 106*b* and the ground conductors 104*a* located in the second-to-last and third-to-last outer layers of the array is different from the pitch $P_0$ separating two of the conductors 102, 202 arranged in the inner layers of the array.

In the lead frame 100, 200 according to the present invention, the specific arrangement of the width $W_1$, $W_2$ of the outer conductors and the pitch $P_1$ separating the outer conductors may be combined with one another. Hence, according to the present invention, the lead frame 100, 200 is provided, wherein the last signal conductor 106*a* and the last ground conductor 204*a* on both ends of the lead frame 100, 200 has a width $W_1$ that is larger than the width $W_0$ of the inner conductors. Further, the width $W_2$ of the second-to-last signal conductor 106*b* and the second-to-last ground conductor 204*b* on both ends of the lead frame 100, 200 is smaller than the width $W_0$ of inner conductors in the lead frame. The pitch $P_1$ separating the last outer signal conductor 106*a* and the last outer ground conductor 204*a* and the second-to-last outer signal conductor 106*b* and the second-to-last ground conductor 204*b* is different from the pitch $P_0$ separating the two inner conductors arranged in the inner layers of the lead frames 100, 200. The pitch $P_2$ separating the second-to-last signal conductor 106*b* and the second-to-last ground conductor 204*b* and the third-to-last signal conductor 104*a* and the third-to-last ground conductor 206*a* of the lead frame 100, 200 is different from the pitch $P_0$ separating the two inner conductors of the lead frames 100, 200.

Figure 14:
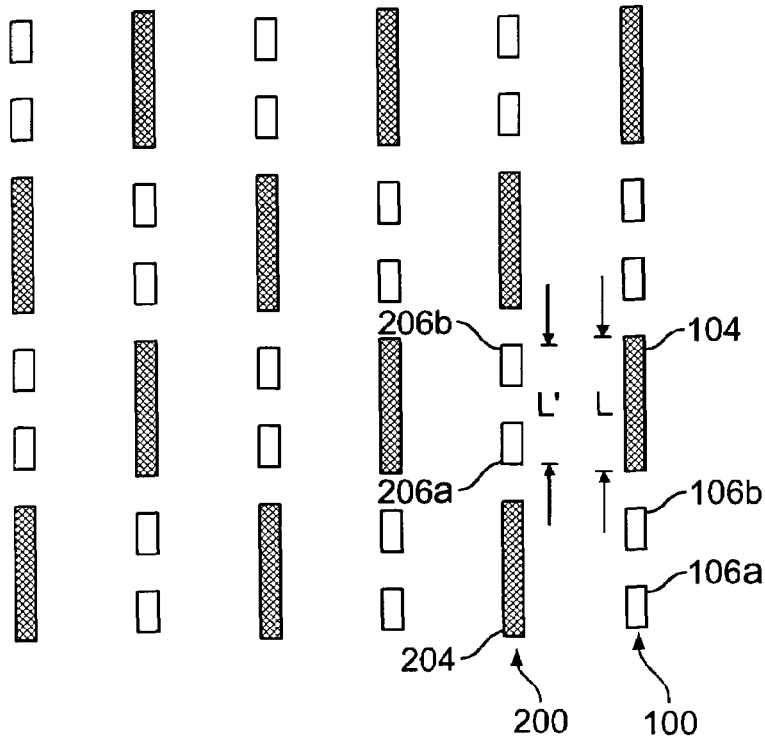
FIG. 14 is a cross-sectional view of the plurality of lead frames shown in FIG. 9, taken along one of lines E-E or F-F shown in FIGS. 10 and 11.

FIG. 14 shows a cross-sectional view through the plurality of lead frames 100, 200 taken along one of lines E-E or F-F shown in FIGS. 10 and 11. This figure illustrates the advantageous arrangement of the signal conductors 106*a*, 106*b* and the ground conductors 104 of the lead frame 100 in an alternating sequence with respect to the signal conductors 206*a*, 206*b* and the ground conductors 204 of the lead frame 200. According to a further preferred embodiment, a width L transverse to the longitudinal path of the ground conductors 104, 204 is substantially equal to a combined transverse width L' of a pair of the signal conductors 106*a*, 106*b*, 206*a*, 206*b* in an adjacent one of the lead frames 100, 200.

Figure 15:
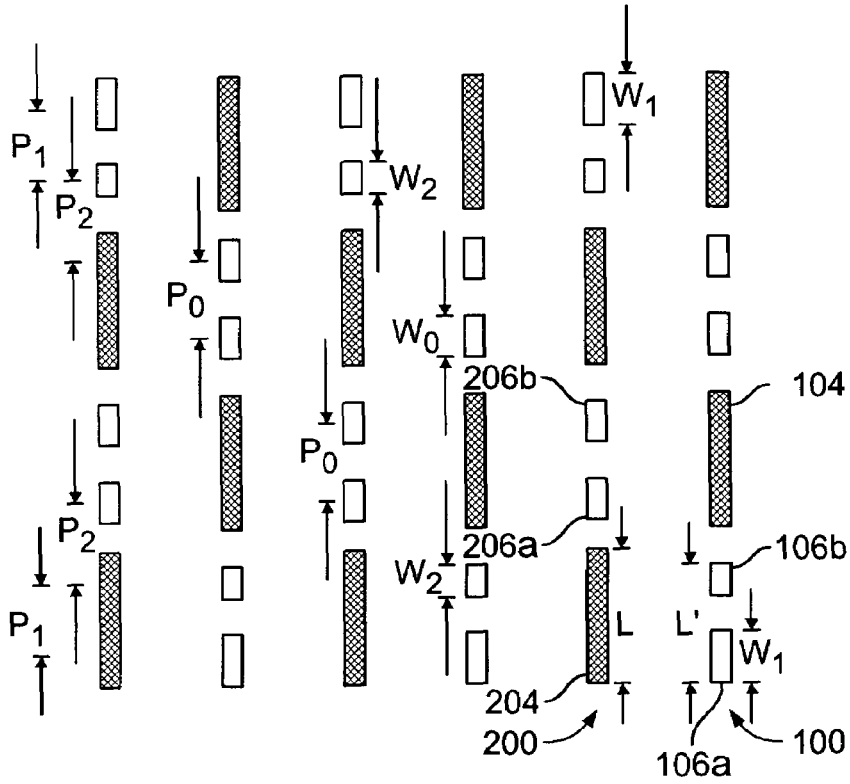
FIG. 15 is a cross-sectional view of the plurality of lead frames according to a preferred embodiment of the present invention, taken along one of the lines E-E or F-F shown in FIGS. 10 and 11.

FIG. 15 illustrates an advantageous embodiment of the present invention, when this alternating sequence of the signal conductors 106*a*, 106*b*, 206*a*, 206*b* and the ground conductors 104, 204 shown in FIG. 14 is combined with the specific width and pitch arrangements of the outer conductors in the plurality of lead frames 100, 200 shown in FIG. 12.

FIG. 15 shows a cross-sectional view through a plurality of the lead frames 100, 200 according to a particular advantageous embodiment of the present invention. A plurality of the lead frames 100, 200 is provided with the signal conductors 106*a*, 106*b*, 206*a*, 206*b* and the ground conductors 104, 204 arranged according to the alternating sequence of a first and second pattern. In the lead frame 100 with the signal conductors 106*a*, 106*b*, 206*a*, 206*b* and the ground conductors 104, 204 arranged according to the first pattern, the outer signal conductors 106*a* on both ends of the lead frame 100 have a width $W_1$ that is larger than the width $W_0$ of the inner conductors. Further, the width $W_2$ of the second-to-last outer signal conductors 106*b* on both ends of the lead frame 100 is smaller than the width $W_0$ of the inner conductors in the lead frame 100. The pitch $P_1$ separating the last outer signal conductors 106*a* and the second-to-last outer signal conductors 106*b* is different from the pitch $P_0$ separating the two inner conductors arranged in the inner layers of the lead frame 100. Since an arrangement of the signal conductors 106*a*, 106*b*, 206*a*, 206*b* and the ground conductors 104, 204 according to the alternating sequence represented in FIG. 14 is foreseen, the pairs of outer signal conductors 106*a*, 106*b* alternate with the individual ground conductors 104. The pitch $P_2$ separating the second-to-last signal connectors 106*b* and the ground conductors 104 of the lead frame 100 is different from the pitch $P_0$ separating the two inner conductors of the lead frames 100, 200. According to an advantageous embodiment, the width L transverse to the longitudinal path of the ground conductors 104 is substantially equal to a combined transverse width L' of a pair of the signal conductors 206*a*, 206*b* in the adjacent lead frame 200.

Figure 16:
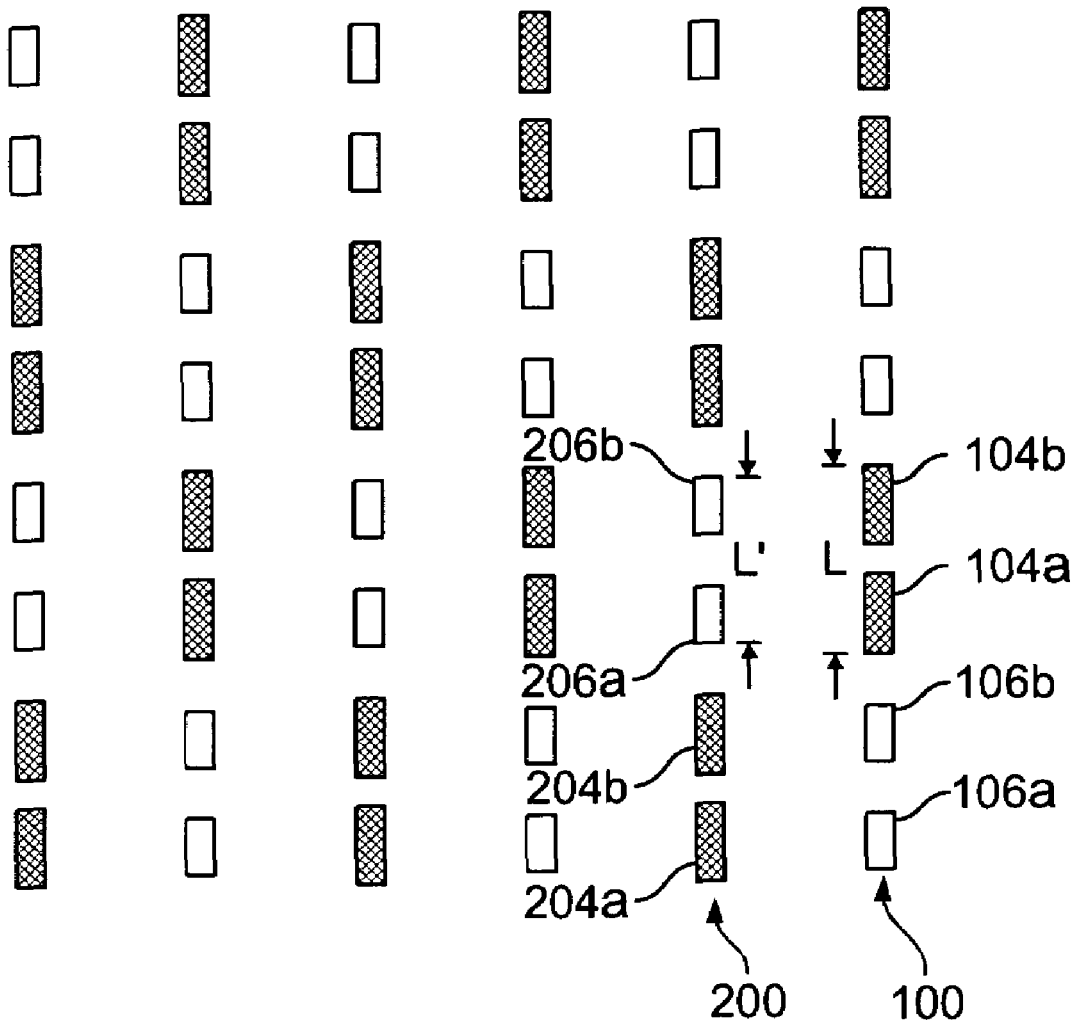
FIG. 16 is a cross-sectional view of the plurality of lead frames according to a further embodiment of the present invention, taken along one of the lines E-E or F-F shown in FIGS. 10 and 11.

FIG. 16 shows a cross-sectional view of the plurality of lead frames 100, 200 according to yet a further aspect of the present invention, taken along the lines E-E or F-F shown in FIGS. 10 and 11. The ground conductors 104, 204 may be separated into two ground conductors 104*a*, 104*b*, 204*a*, 204*b*. The electrical shielding provided by a pair of the ground conductors 104*a*, 104*b*, 204*a*, 204*b* is equivalent to the electrical shielding provided by the ground conductor 104, 204 formed as one shielding blade. This special arrangement of the pair of ground conductors 104*a*, 104*b*, 204*a*, 204*b* provides the advantage of rendering different signal/ground assignments possible.

Even though the preferred embodiments of the present invention describe in more detail the situation where the plurality of conductors 102, 202 within the electrical connector 10 have an equal width along the predetermined path, the present invention is not limited to such a situation. In fact, it will be apparent to a person skilled in the art that it is sufficient that at least a portion of the signal conductors 106*a*, 106*b* and the ground conductors 204*a*, 204*b* in the outer layers has a width $W_1$, $W_2$ transverse to the predetermined path that is different from a width $W_0$ transverse to the predetermined path of the signal conductors 206*a*, 206*b* and the ground conductors 104*a*, 104*b* in the inner layers.

Further, although the present application describes in detail the preferred embodiment of a rectangular or square array, a plurality of the conductors 102, 202 with a curved cross-section may also be foreseen in the electrical connector 10, the plurality of conductors 102, 202 being arranged in such a way that they form an essentially curved array. Preferentially, the plurality of conductors 102, 202 is foreseen with a circular cross-section. The plurality of conductors 102, 202 are arranged in such a way that they form an essentially circular array. In the case of a circular array of conductors 102, 202, the term width defined in the present application shall then mean the diameter of the conductors 102, 202.

Moreover, even though the embodiments and figures of the present application describe in more detail the situation where the signal conductors 106*a*, 106*b*, 206*a*, 206*b* are shielded by an identical number of the adjacent ground conductors 104, 204, the present invention also covers a situation where not all of the signal conductors 106*a*, 206*b*, 206*a*, 206*b* are shielded by an identical number of the ground conductors 104, 204. The pin assignment of an electrical connector 10 according to the present invention is not determined beforehand but can be set when being implemented in a particular application, which provides for a high degree of flexibility.

The electrical connector 10 according to the present invention has improved electrical characteristics, in particular, uniform electrical properties of the conductors 102, 202 within the electrical connector 10. Moreover, the electrical connector 10 according to the present invention achieves a high speed signal transport through a right angle or vertical interconnection system while having both a high signal density as well as an easy track-routing on the circuit board 80. Various termination techniques for board mounting, such as surface mounting or press-fit, can be applied to mount the electrical connector 10 according to the present invention on the corresponding circuit board 80.

Finally, according to yet another aspect of the present invention, the electrical connector 10 integrates the lead frames 100, 200 that are arranged with an alternating sequence of the ground conductors 104, 204 and the signal conductors 106*a*, 106*b*, 206*a*, 206*b*. This alternating lead frame design allows for an improved electrical shielding between different pairs of the signal conductors 106*a*, 106*b*, 206*a*, 206*b* carrying differential signals.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical connector, comprising:

a dielectric housing provided with a plurality of contact modules, each of the contact modules provided with a lead frame having mounting contacts electrically connected to mating contacts by signal conductors and ground conductors that extend along a predetermined path within the contact module;

the lead frames in adjacent contact modules alternating between a first pattern and a second pattern, the first pattern and the second pattern each having pairs of signal conductors and individual ground conductors arranged in an alternating sequence; and each of the ground conductors having a width transverse to the predetermined path that is substantially equal to a combined width transverse to the predetermined path across the pair of signal conductors in the adjacent contact module such that the ground conductor shields the pair of signal conductors in the adjacent contact module.

2. The electrical connector of claim 1, wherein the mounting contacts extend substantially perpendicular to the mating contacts.

3. The electrical connector of claim 1, wherein the contact modules have a mating face provided with a circuit board, the mounting contacts extending from the mating face and being electrically connected to the circuit board.

4. The electrical connector of claim 1, wherein the electrical connector is a female electrical connector.

5. The electrical connector of claim 1, wherein the individual ground conductor electrically connects a pair of the mounting contacts to a pair of the mating contacts.

6. The electrical connector of claim 1, wherein the mating contacts in each of the lead frames are arranged in a single row and the mounting contacts in each of the lead frames are arranged in a single row.

7. The electrical connector of claim 1, wherein in a cross-section each of the signal conductors and each of the ground conductors of the contact modules are arranged in an array having outer layers and inner layers, the width transverse to the pre-determined path of each of the signal conductors and each of the ground conductors of the outer layers is different from the width transverse to the pre-determined path of each of the signal conductors and each of the ground conductors of the inner layers.

8. The electrical connector of claim 7, wherein the array is substantially square or rectangular.

9. The electrical connector of claim 7, wherein a pitch between the outer layers is different from a pitch between the inner layers.

10. The electrical connector of claim 7, wherein the width transverse to the pre-determined path of each of the signal conductors and each of the ground conductors of an outermost layer of the outer layers is greater than the width transverse to the pre-determined path of each of the signal conductors and each of the ground conductors of a remainder of the outer layers.

11. The electrical connector of claim 10, wherein the width transverse to the pre-determined path of each of the signal conductors and each of the ground conductors of the remainder of the outer layers is smaller than the width transverse to the pre-determined path of each of the signal conductors and each of the ground conductors of the inner layers.

12. An electrical connector, comprising:

a dielectric housing provided with a plurality of contact modules, each of the contact modules provided with a lead frame having mounting contacts electrically connected to mating contacts by signal conductors and ground conductors that extend along a predetermined path within the contact module;

the lead frames in adjacent contact modules alternating between a first pattern and a second pattern, the first pattern and the second pattern each having pairs of signal conductors and pairs of ground conductors arranged in an alternating sequence; and each of the pairs of ground conductors having a combined width transverse to the predetermined path that is substantially equal to a combined width transverse to the predetermined path across the pair of signal conductors in the adjacent contact module such that the pair of ground conductors shields the pair of signal conductors in the adjacent contact module.

13. The electrical connector of claim 12, wherein the mounting contacts extend substantially perpendicular to the mating contacts.

14. The electrical connector of claim 12, wherein the contact modules have a mating face provided with a circuit board, the mounting contacts extending from the mating face and being electrically connected to the circuit board.

15. The electrical connector of claim 12, wherein the electrical connector is a female electrical connector.

16. The electrical connector of claim 12, wherein the mating contacts in each of the lead frames are arranged in a single row and the mounting contacts in each of the lead frames are arranged in a single row.

17. The electrical connector of claim 12, wherein in a cross-section each of the signal conductors and each of the ground conductors of the contact modules are arranged in an array having outer layers and inner layers, the width transverse to the pre-determined path of each of the signal conductors and each of the ground conductors of the outer layers is different from the width transverse to the pre-determined path of each of the signal conductors and each of the ground conductors of the inner layers.

18. The electrical connector of claim 17, wherein the array is substantially square or rectangular.

19. The electrical connector of claim 17, wherein a pitch between the outer layers is different from a pitch between the inner layers.

20. The electrical connector of claim 17, wherein the width transverse to the pre-determined path of each of the signal conductors and each of the ground conductors of an outermost layer of the outer layers is greater than the width transverse to the pre-determined path of each of the signal conductors and each of the ground conductors of a remainder of the outer layers.

21. The electrical connector of claim 20, wherein the width transverse to the pre-determined path of each of the signal conductors and each of the ground conductors of the remainder of the outer layers is smaller than the width transverse to the pre-determined path of each of the signal conductors and each of the ground conductors of the inner layers.

* * * * *